United States Patent [19]

Brodie

[11] Patent Number: 4,721,885

[45] Date of Patent: Jan. 26, 1988

[54] VERY HIGH SPEED INTEGRATED MICROELECTRONIC TUBES

[75] Inventor: Ivor Brodie, Palo Alto, Calif.

[73] Assignee: SRI International, Menlo Park, Calif.

[21] Appl. No.: 13,560

[22] Filed: Feb. 11, 1987

[51] Int. Cl.[4] ..... H01J 1/30; H01J 7/06; H01J 17/48

[52] U.S. Cl. ..... 313/576; 313/574; 313/584; 313/606; 313/620; 313/309; 313/336; 313/351

[58] Field of Search ..... 313/336, 309, 606, 620, 313/351, 574, 575, 576, 584

[56] References Cited

U.S. PATENT DOCUMENTS

| | | | |
|---|---|---|---|
| 2,692,948 | 10/1954 | Lion | 250/65 |
| 3,767,968 | 10/1973 | Ogle | 313/351 X |
| 3,789,471 | 2/1974 | Spindt et al. | 29/25.17 |
| 3,855,499 | 12/1974 | Yamada et al. | 315/169 R |
| 3,921,022 | 11/1975 | Levine | 313/309 |
| 3,970,887 | 7/1976 | Smith et al. | 313/309 |
| 3,998,678 | 12/1976 | Fukase et al. | 156/3 |
| 4,008,412 | 2/1977 | Yuito et al. | 313/309 |
| 4,020,381 | 4/1977 | Oess et al. | 313/302 |
| 4,081,712 | 3/1978 | Bode et al. | 313/226 |
| 4,095,133 | 6/1978 | Hoeberechts | 313/336 |
| 4,163,949 | 8/1979 | Shelton | 313/351 X |
| 4,307,507 | 12/1981 | Gray et al. | 29/580 |

OTHER PUBLICATIONS

T. R. Shoulders, "Microelectronics Using Electron-Beam-Activated Machining Techniques", Advances in Computers, 2, pp. 135–197. Academic Press, New York, London, 1961.

*Primary Examiner*—Palmer C. DeMeo

*Attorney, Agent, or Firm*—Victor R. Beckman

[57] ABSTRACT

An array of microelectronic tubes is shown which includes a plate-like substrate upon which an array of sharp needle-like cathode electrodes is located. Each tube in the array includes an anode electrode spaced from the cathode electrode. The tubes each contain gas at a pressure of between about 1/100 and 1 atmosphere, and the spacing between the tip of the cathode electrodes and anode electrodes is equal to or less than about 0.5 μm. The tubes are operated at voltages such that the mean free path of electrons travelling in the gas between the cathode and anode electrodes is equal to or greater than the spacing between the tip of the cathode electrode and the associated anode electrode. Both diode and triode arrays are shown.

20 Claims, 6 Drawing Figures

FIG-1
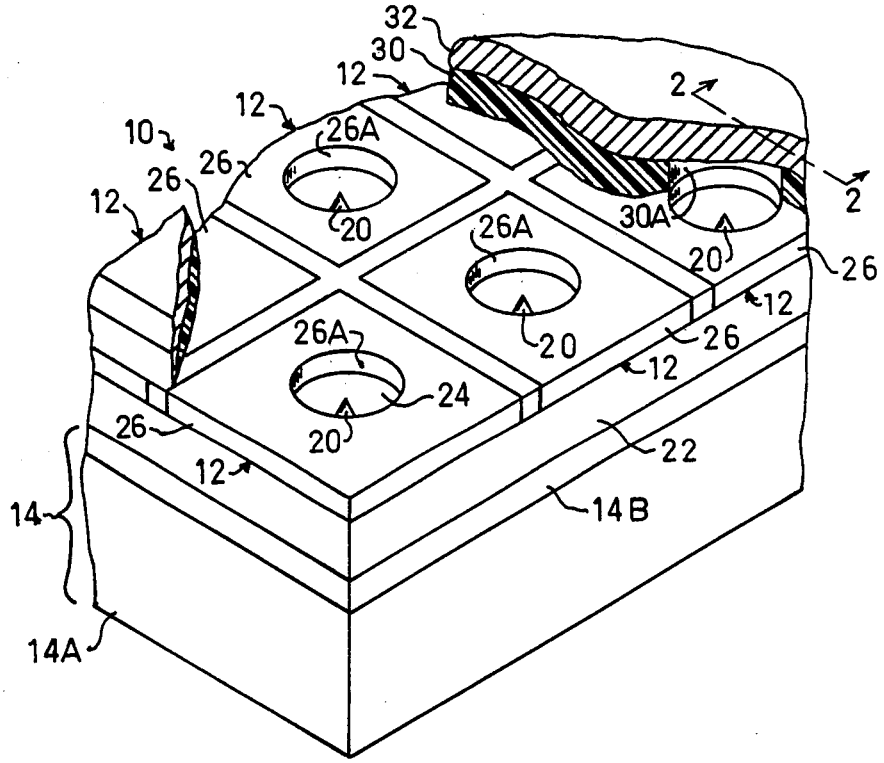
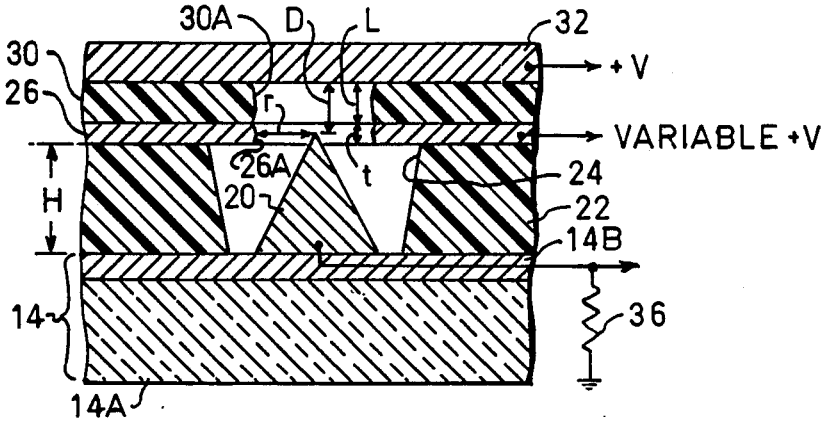
FIG-2

FIG-5
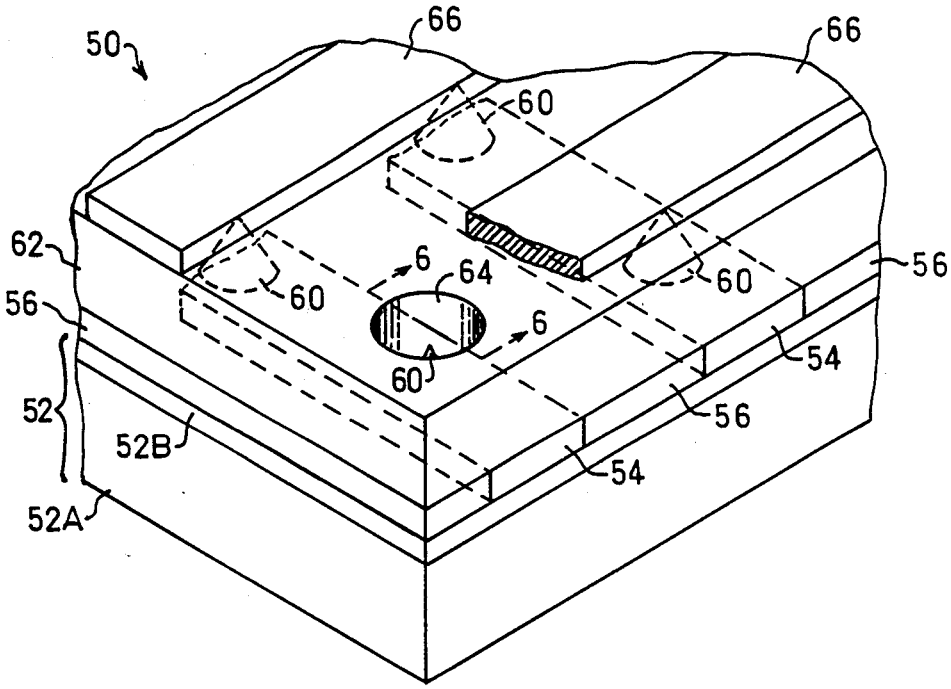
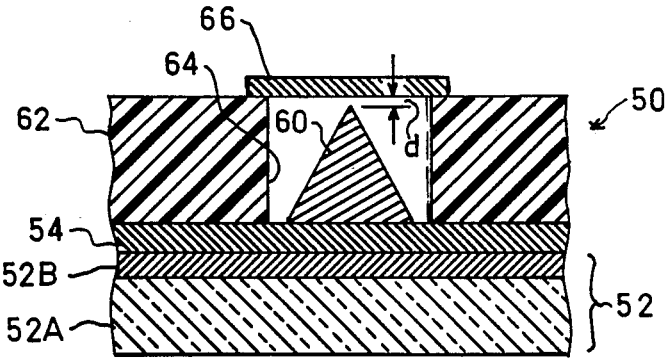
FIG-6

VERY HIGH SPEED INTEGRATED MICROELECTRONIC TUBES

FIELD OF THE INVENTION

This invention relates to integrated microelectronic tubes having field emission cathode structures which operate as vacuum tubes but at pressures ranging from about 1/100 to 1 atmosphere.

BACKGROUND OF THE INVENTION

Integrated microelectronic tubes having field emission cathode structures are well known as shown, for example, in U.S. Pat. Nos. 3,789,471, Spindt et al; 3,855,499, Yamada et al; and, 3,921,022, Levine. For such devices to function in the manner of vacuum tubes they must be fabricated with a high vacuum. However, to-date, no practical, commercially economical, means for producing such tubes with a high vacuum has been found. Consequently, substantially no use has been made of such tubes as vacuum devices.

OBJECTS AND SUMMARY OF THE INVENTION

An object of this invention is the provision of an improved integrated microelectronic device which includes a field emission cathode structure, which device may be readily and inexpensively produced and which operates in the manner of a vacuum tube but without the need for a high vacuum.

An object of this invention is the provision of an improved integrated microelectronic device of the above-mentioned type for use in very high speed integrated circuits which are capable of switching at speeds substantially faster than comparable gallium arsenide devices.

An object of this invention is the provision of an improved integrated microelectronic device of the above-mentioned type which occupies a small space per tube, dissipates a small amount of power in the "on" mode, does not necessitate the use of single-crystal materials, is radiation hard, can be operated over a wide range of temperatures, and may be integrated to contain a large number of circuit elements on a single substrate.

The above and other objects and advantages of this invention are achieved by use of a field emission tube whose dimensions are sufficiently small that the mean free path of electrons travelling between the tube cathode and anode is larger than the interelectrode distances, even at atmospheric or close to atmospheric pressure, say, between 1/100 to atmosphere, and whose voltage of operation is less than the ionization potential of the residual gas. Because a high vacuum is not required for operation, tubes of this type are relatively easily produced, and air or other gases may be employed therein. A variety of circuits may be fabricated using tubes of this invention. For example, high speed memory circuits, may be made wherein tubes are interconnected to provide flip-flop circuits which function as memory elements.

BRIEF DESCRIPTION OF THE DRAWINGS

The invention, together with other objects and advantages thereof will be better understood from the following description considered with the accompanying drawings. In the drawings, wherein like reference characters refer to the same parts in the several views:

FIG. 1 is a fragmentary enlarged perspective view of an array of field emission tubes showing the anode and insulator that separates the anode from the gate broken away for clarity;

FIG. 2 is an enlarged sectional view taken along line 2—2 of FIG. 1,

FIG. 5 is a fragmentary enlarged perspective view which is similar to that of FIG. 1 but showing an array of field emission diodes instead of triodes, and FIG. 6 is an enlarged sectional view taken along line 6—6 of FIG. 5.

Reference first is made to FIG. 1 wherein an array 10 of microelectronic devices 12 is shown formed on a substrate 14. In FIG. 1 the devices are shown to comprise triode type "vacuum" tubes. As will become apparent, diodes, tetrodes and other types of tubes may be constructed in accordance with the present invention, which devices function as vacuum tubes yet contain a gas. Also, by way of example and not by way of limitation, up to $2\times10^8$ devices/cm$^2$ may be formed on substrate 14. From the above, it will be apparent that the devices are depicted on a greatly enlarged scale in the drawings.

Figure 3:
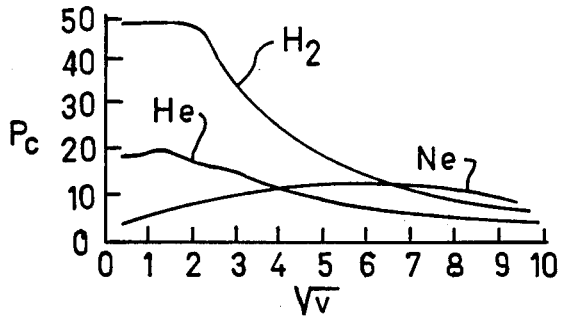
FIGS. 3 and 4 are graphs showing probability of collision of electrons in various gases versus electron velocity (which is proportional to $\sqrt{\text{voltage}}$)

The substrate 14 provides a support for the array 10 of tubes 12 formed thereon. In the illustrated arrangement, substrate 14 comprises a base member 14A together with a silicon layer 14B deposited thereon. Base member 14A may be made of ceramic, glass, metal, or like material, and for purposes of illustration a glass member is shown. Silicon layer 14A is adapted for use in forming leads for cathodes 20 formed thereon. An array of individual cathodes 20 is formed on silicon layer 14B, each of which comprises a single needle-like electron emitting protuberance. Protuberances 20 may be formed of a refractory metal such as molybdenum or tungsten.

A dielectric film 22, such as a film of silicon dioxide, is deposited over the surface of silicon layer 14B, which film is provided with an array of apertures 24 through which the emitter electrode protuberances 20 extend. Gate, or accelerator, electrodes 26 are formed as by depositing a metal layer on the dielectric film 22. For purposes of illustration, crossing rows and lines 28 of insulating material are shown dividing film 26 into an array of individual gate electrodes. Gate electrodes 26 are the equivalent of control grids of conventional vacuum tubes. The upper tips of the cathode protuberances terminate at a level intermediate the upper and lower surfaces of gate electrodes 26 at substantially the center of aperture 26A in the electrodes for maximizing the electric field at the tips under tube operating conditions.

An insulating layer 30 is deposited on the gate electrodes 26, which layer is formed with apertures 30A that are axially aligned with apertures 26A in the gate electrodes. A metal anode 32 is affixed to the insulating layer 30 which, if desired, may comprise an unpatterned plane metal sheet which requires no alignment when pressed over the insulating surface. A gas-containing space is formed between the anode 32 and layer 14B upon which the cathode protuberances 20 are formed. Unlike prior art arrangements wherein a vacuum is provided, tubes of the present invention include a gas at a pressure of between approximately 1/100 to 1 atmosphere in the interelectrode space.

Methods of producing tubes of this type are well known as shown and described, for example, in the above-mentioned U.S. Pat. No. 3,789,471. With current fabrication methods, dimensions as small as H=1.5 μm, t=0.5 μm and r=0.6 μm may be achieved where H is the thickness of insulating layer 22, t is the thickness of the gate electrode 26 and r is the radius of aperture 26A in the gate electrode, as identified in FIG. 2. Also, a distance D of approximately 0.5 μm between the tip of cathode 20 and the anode 32 is contemplated through use of an insulating layer 30 with thickness on the order of 0.25 μm.

PRINCIPLES OF OPERATION

It is known that the mean free path λ of an electron in a gas traveling at velocity v (corresponding to a potential V) is given by $$\lambda = \frac{T}{273pP_c(V)} \text{ cm}, \quad (1)$$

where:

p=pressure in torr,

T=absolute temperature, and $P_c(V)$=probability of collision for an electron of energy eV.

Rearranging equation (1) provides an expression for probability of collision as follows:

$$P_c(V) = \frac{T}{273p\lambda} \quad (2)$$

Using equation (2) and assuming that:

T=300 K.

p=760 torr=one atmosphere, and

λ≧0.5 μm, then $P_c(V)$ would have to be <30 for a tube with the above-mentioned D=0.5 μm dimension to operate substantially without collision of electrons with gas contained therewithin.

Figure 4:
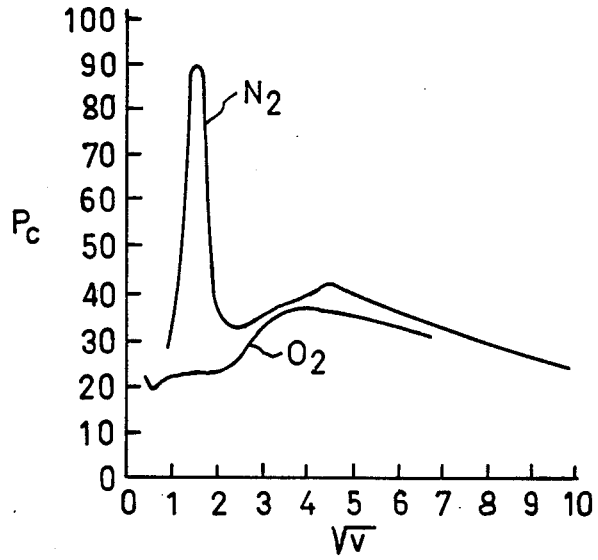

Probability of collision, $P_c$, is a function of the electron velocity (or $\sqrt{\text{voltage}}$), and this function has been measured for many gases. Functions of probability of collision versus $\sqrt{\text{voltage}}$ for $H_2$, Ne, and He are shown in FIG. 3, and for $N_2$ and $O_2$ (the major constituents of air) are shown in FIG. 4. It will be noted that often $P_c$ has a maximum in the range of 2–10 volts as a result of the Ramsauer effect. If air is employed in the tubes, operating voltages would have to be away from the nitrogen peak which occurs at approximately 2.6 volts. As seen in FIG. 4, the probability of collision for both nitrogen and oxygen gases exceed 30 over a substantial portion of the voltage range, thereby precluding operation within said voltage range. However, by reducing the pressure of air ($N_2$ and $O_2$) within the tube, the probability of collision may be reduced to an acceptable value. For example, operation at 0.5 atmosphere air pressure reduces the probability of collision to an acceptable value at all operating voltages away from the nitrogen peak.

From an examination of FIG. 3, it will be seen that for both neon and helium, the probability of collision, $P_c$, is less than 20 for all electron energies. Consequently, neon and helium at atmospheric pressure may be employed in the tubes. They are excellent gases to use because they are non-reactive and inexpensive. For helium, the minimum electron energy for ionization is 24.6 eV. Also, helium penetrates most materials very easily, and if necessary can be used to displace the air in the tube volume.

Using the above-mentioned dimensions (i.e. r=0.6 μm, H=1.5 μm and t=0.5 μm) a gate voltage of about +40 V (relative to the cathode) is required to extract 1 to 10 μA from the cathode tip. With the anode 32 spaced 0.5 μm from the tip, an anode voltage of about 75 to 100 V is required to ensure that no electrons return to the gate. Extrapolation of existing experimental data indicates that by reducing r to ≈0.3 μm, it should be possible to reduce the gate voltage to ≈5 V and hence operate at an anode voltage of 10 to 20 V. With the illustrated construction wherein the array of tubes is provided with a common anode, operation of the tubes at a constant anode voltage is provided. A variable gate voltage is provided for switching the tube between on and off conditions in the case the tubes are used in, say, a binary circuit such as a memory circuit. The tube output may be obtained from across a load resistor 36 connected between the cathode 20 and ground.

With the present invention the tubes function as vacuum tubes even though they contain gas at a pressure of between 1/100 atmosphere to 1 atmosphere. This results from the fact that the construction and operating conditions are such that the mean free path of electrons is equal to or greater than the spacing between the cathode and anode between which the electrons travel, which spacing in accordance with the present invention is no greater than about 0.5 μm.

With the present construction, the assembly step that includes providing a gas in the interelectrode space is readily accomplished by simply performing assembly in a gaseous environment with the desired gas and at the desired pressure. Gas pressures of, say, between 1/100 and 1 atmosphere are readily produced and easily maintained during the assembly step at which gas is sealed within the tubes. For example, in the illustrated construction, the anode 32 may be applied within the desired gaseous environment, say, within an environment of helium at substantially atmospheric pressure. Upon bonding the anode 32 to the insulating layer 30, the interelectrode space is sealed thereby containing the gas within the tubes. No deep vacuum pumping of the tubes is required to provide for an operative array of tubes.

Advantages of the novel triode tubes of this invention include the fast switching speed compared, say, to silicon, gallium arsenide, and indium phosphorus devices. Reference is made to Table 1 showing maximum drift velocity, field strength, transit time for a distance of 0.5 μm, and applied voltage across 0.5 μm of the above-mentioned media and for a vacuum. In the table the maximum values of drift velocities of electrons in the semiconductors Si, GaAs and InP are employed, which drift velocities are obtained from graphs of drift velocity of electrons as a function of electric field for the semiconductors. Because the tip of cathode 20 is only about 0.05 μm in diameter (using prior art construction methods) and because most of the acceleration occurs within 0.15 μm of the tip, it is assumed that the interelectrode distance is travelled at an essentially uniform velocity given by $$v = \sqrt{\frac{2eV}{m}} \quad (3)$$

TABLE 1

| Medium | Silicon | GaAs | InP | Vacuum* |
|---|---|---|---|---|
| Maximum Velocity (m/s) | $10^5$ | $2 \times 10^5$ | $2.2 \times 10^5$ | $6 \times 10^5 V^{\frac{1}{2}}$ |
| Obtained With A Field of (V/m) | $6 \times 10^6$ | $0.8 \times 10^6$ | $2 \times 10^6$ | $3.2 \times 10^7$ |
| Transit Time (s) For D = 0.5 μm | $5 \times 10^{-12}$ | $2.5 \times 10^{-12}$ | $2.27 \times 10^{-12}$ | $2.1 \times 10^{-13}$ |
| Applied Voltage Across 0.5 μm (volts) | 3 | 0.4 | 1 | 16 |

*Field Limited By Breakdown across the insulator at about $5 \times 10^7$ V/m.

From Table 1 it will be seen that the "vacuum" tubes of this invention are capable of a switching speed about ten times better than the best semiconductor now available.

In order to detect whether current is flowing, the transport of 200 electrons is sufficient to have an average error rate of 1 in $10^{12}$, assuming Poisson statistics. If the need is to detect whether a circuit has current flowing in a time of $10^{-9}$ seconds, then the current flowing in the tube must be $$\frac{200 \times 1.6 \times 10^{-19}}{10^{-9}} = 3.2 \times 10^{-8} A$$

Thus, although the fluctuations in the field emitter may be greater than Poisson, it reasonably may be assumed that an 'on' current of $10^{-6}$ A/tip is more than adequate for detecting current flow at gigabit rates. The power dissipated by a pair of 'on' tubes with this current flowing and 16 V anode voltage will be $3.2 \times 10^{-5}$ W. With each microtube occupying about $2.5 \times 10^{-9}$ cm$^2$ of surface area, it is possible to pack up to a density of about $10^8$ memory circuits/cm$^2$.

Reference now is made to FIGS. 5 and 6 wherein an array 50 of microelectronic diodes is shown formed on a substrate 52. For purposes of illustration only, substrate 52 upon which the diode array is supported is shown to comprise a base member 52A of ceramic, glass, metal, or the like, and a silicon layer 52B deposited thereon. Alternating rows of conducting cathode connectors 54 and insulating material 56 are deposited on silicon layer 52B. A linear array of individual cathodes 60 is formed on each of the cathode connectors 54, each of which cathodes comprise a single needle-like electron emitting protuberance. As with the above-described triode array, protuberances 60 may be formed of a refractory metal such as molybdenum or tungsten.

A dielectric film 62 is deposited over the surfaces of the cathode connectors 54 and adjacent insulating material 56, which film is provided with an array of apertures 64 into which the emitter electrode protuberances 60 extend. The upper tips of the cathode protuberances terminate a short distance d below the upper surface of insulating layer 62.

Rows of metal anode electrodes 66 are affixed to the insulating layer 62, which anode electrodes extend in a direction at right angles to the rows of cathode connectors 54. A gas-containing space is provided at each cathode 60 between the rows of anodes and crossing rows of cathode connectors, which space is filled with gas at a pressure of between approximately 1/100 and 1 atmosphere. A distance d on the order of 0.5 μm is provided between the tip of cathode 60 and anode 66. As with the triode tube embodiment, the diode array is operated at voltages wherein the mean free path of electrons travelling in the gas between the cathode and anode electrodes is equal to or greater than the spacing d between the tip of the cathode electrode and the associated anode electrode. As with the above-described triode tube array, gases including air, neon, helium, or the like, may be employed in the diode array structure. As with the triodes, the diodes function as vacuum tubes even though they contain gas at a pressure of between 1/100 atmosphere to 1 atmosphere. Also, the anode strips 66 may be affixed to the insulating layer 62 in a gaseous environment of the desired gas at the desired pressure whereby the gas-containing space between the diode cathode and anode, contains the gas upon completion of attachment of the anodes to layer 62. There is no requirement to reduce the gas pressure in the interelectrode space after assembly of the tubes.

The invention having been described in detail in accordance with requirements of the Patent Statutes, various changes and modifications will suggest themselves to those skilled in this art. For example, the triode type tubes may be provided with a separate anode, if desired, in which case connection of the anodes to a positive voltage source (relative to the cathode) through individual load resistors is possible. With this structure, the triode cathodes may be formed on a conducting substrate which may be connected to a common d-c supply source. Also, it will be apparent that gases other than air, neon, and helium may be employed in the tubes. It is intended that the above and other such changes and modifications shall fall within the spirit and scope of the invention as defined in the appended claims.

I claim:

1. An array of microelectronic tubes comprising a substrate, an array of sharp needle-like cathode electrodes each with at least one tip carried by the substrate, each tube including an anode electrode spaced from the tip of a cathode electrode for receiving electrons emitted by field emission from said cathode electrode, insulating means separating and insulating said cathode electrodes from said anode electrodes, said insulating means including a plurality of through apertures into which the cathode electrodes extend, each tube containing a gas at a pressure of between about 1/100 and 1 atmosphere, and means for supplying operating voltages to the tubes whereby the mean free path of electrons travelling in said gas between said cathode and anode electrodes is equal to or greater than the spacing between the tip of the cathode electrode and the associated anode electrode and the maximum energy gained by the electrons is less than the ionization potential of the constituent gas.

2. An array of microelectronic tubes as defined in claim 1 wherein the interelectrode spacing between the cathode and anode electrodes of the tubes is ≦ about 0.5 μm.

3. An array of microelectronic tubes as defined in claim 1 wherein the gas comprises air.

4. An array of microelectronic tubes as defined in claim 1 wherein the gas comprises helium.

5. An array of microelectronic tubes as defined in claim 1 wherein the gas comprises neon.

6. An array of microelectronic tubes as defined in claim 1 wherein said substrate comprises a glass base with a layer of silicon thereon.

7. An array of microelectronic tubes as defined in claim 1 wherein said tubes comprise diodes, said array including rows of cathode connectors on the substrate connected to rows of said cathodes, and said array including rows of anode electrodes extending in a direction at right angles to the direction of the rows of cathode connectors.

8. An array of microelectronic tubes as defined in claim 1 wherein each said tube includes a gate electrode having an aperture therethrough in alignment with an associated aperture in said insulating means and into which gate aperture the tip of the associated cathode electrode extends.

9. An array of microelectronic tubes as defined in claim 1 wherein at least one of the cathode and anode electrodes is applied to the array of tubes in the presence of gas of the type and pressure contained in the tubes.

10. An array of microelectronic tubes comprising a substrate, an array of sharp needle-like cathode electrodes each with at least one tip formed on the substrate, each tube including a gate electrode having an aperture therethrough into which aperture the tip of an associated cathode electrode extends, insulating means separating and insulating said cathode electrodes from said gate electrodes, said insulating means including a plurality of through apertures in alignment with apertures in the gate electrodes, each tube including an anode electrode spaced from said gate and cathode electrodes for receiving electrons emitted by field emission from said cathode electrodes, each tube containing gas at a pressure of between about 1/100 and 1 atmosphere, and means for supplying operating voltages to the tubes, whereby the mean free path of electrons travelling in said gas between said cathode and anode electrodes is equal to or greater than the spacing between the tip of the cathode electrode and the associated anode electrode and the maximum energy gained by the electrons is less than the ionization potential of the constituent gas.

11. An array of microelectronic tubes as defined in claim 10 wherein the interelectrode spacing between the cathode and anode electrodes of the tubes is $\leqq$ about 0.5 $\mu$m.

12. An array of microelectronic tubes as defined in claim 10 wherein the gas comprises air.

13. An array of microelectronic tubes as defined in claim 10 wherein the gas comprises helium.

14. An array of microelectronic tubes as defined in claim 10 wherein the gas comprises neon.

15. An array of microelectronic tubes as defined in claim 10 including insulating means separating and insulating said gate and anode electrodes and having a plurality of through apertures in alignment with the gate electrode apertures.

16. An array of microelectronic tubes as defined in claim 15 wherein said anode electrodes comprise a unitary conductive member associated with a plurality of said tubes.

17. An array of microelectronic tubes as defined in claim 15 wherein gas contained in the tubes is supplied by application of said unitary conductive member to the insulating means that separates and insulates the gate and anode electrodes in the presence of gas at a pressure of between about 1/100 and 1 atmosphere.

18. An array of microelectronic tubes as defined in claim 10 wherein said substrate comprises a glass base with a layer of silicon thereon, upon which silicon layer said cathode electrodes are formed.

19. An array of microelectronic tubes as defined in claim 10 wherein said insulating means separating and insulating said cathode electrodes from said gate electrodes comprises a layer of $SiO_2$ formed on said silicon layer.

20. An array of microelectronic tubes as defined in claim 10 wherein at least one of the cathode and gate electrodes is applied to the array of tubes in the presence of gas of the type and pressure contained in the tubes.

* * * * *